United States Patent [19]

Usui

[11] Patent Number: 4,944,969

[45] Date of Patent: Jul. 31, 1990

[54] MULTIPURPOSE BOARD LIKE ARTICLE FOR DECORATION AND AMUSEMENT

[76] Inventor: Nobutane Usui, 36-3, Shimizu 1-chome, Suginami-ku, Tokyo, Japan

[21] Appl. No.: 127,578

[22] Filed: Nov. 25, 1987

Related U.S. Application Data

[63] Continuation of Ser. No. 6/726,101, Apr. 23, 1985, abandoned.

[51] Int. Cl.[5] ..... B44C 5/04; B44F 1/10; G09F 19/00

[52] U.S. Cl. ..... 428/14; 40/409; 428/542.4

[58] Field of Search ..... 428/13, 14, 542.4; 40/152, 160, 409; 434/84, 152

[56] References Cited

U.S. PATENT DOCUMENTS

| | | | |
|---|---|---|---|
| 1,711,701 | 5/1929 | Speck | 428/13 X |
| 1,824,229 | 9/1931 | Pevsner | 428/13 X |
| 3,819,436 | 6/1974 | Allen | 428/13 X |
| 3,992,811 | 11/1976 | Yellin | 428/13 X |
| 4,031,643 | 6/1977 | Templeton | 428/13 X |
| 4,169,323 | 10/1979 | Engel | 428/13 X |
| 4,304,803 | 12/1981 | Allaire et al. | 428/13 X |
| 4,525,945 | 7/1985 | Shultz | 40/152 |
| 4,686,784 | 8/1987 | Smithies | 428/13 X |
| 4,860,469 | 8/1989 | Borse | 40/409 |
| 4,885,192 | 12/1989 | Tabar | 428/14 X |

*Primary Examiner*—Henry F. Epstein
*Attorney, Agent, or Firm*—Ladas & Parry

[57] ABSTRACT

A multipurpose board has a frame circumferentially supporting at least three transparent plates with segregating clearances between the transparent plates. Particles only partially fill each segregating clearance, the particles in the respective segregating clearances having different physical properties. When the board is moved, particle flow in each segregating clearance permitted by the only partial filling thereof forms varieties of wave-like combinations when movement is stopped, which are visible three dimentionally through the transparent plates.

16 Claims, 2 Drawing Sheets

MULTIPURPOSE BOARD LIKE ARTICLE FOR DECORATION AND AMUSEMENT

This is a continuation of Ser. No. 06/726,101 filed Apr. 23, 1985 and now abandoned.

BACKGROUND OF THE INVENTION

This invention relates to an article of decoration and amusement in which particles are used. More specifically, without being limited thereto, it relates to a multipurpose, board-like, article of decoration and amusement in which particles stand still or flow between transparent plates in a frame.

PRIOR ART

Glass-covered containers for many articles are placed in rooms. They are part of interior designs, and take the from of a variety of glass-covered cases and frames.

The inventor applied for registration of a utility model entitled "A Decorative Object Utilizing Sand" in Japan on Mar. 7, 1984, application number 32820/84. The decorative objects are board-like with differing volumes of sand from the Middle East between glass layers. Each evokes the sand waves of a dune, so as to make it a souvenir from that region. If a tourist brings it home from that region, as a personal souvenir or as a gift to friends, it is then also a sample of a mineral from a foreign country, which can also be used as an eductional material.

Although several "decorative articles" of this kind have been prepared, they were not heretofore introduced to the market as commercial products or disclosed to the public. They are that which is most similar to the present invention, however. The flow of sand, into the waves which evoke the dunes after one has held the board in both hands and moved and swung it, makes such a board an amusement, like a toy, too.

Other portable amusement boards are also known. An example of such boards is one with a glass plate on top of a shallow box with steel balls in it for rolling along a path from a starting point to a goal by swinging the board. Its path consists of, for example, a route from city A to city B with holes in a bottom of the box where the balls fall into a double bottom, meaning the failure of the trip. It is a game to compete for arriving at the destination, and one can enjoy the delicate handling required in swinging the board for this. One also can enjoy "scenery" drawn along the route or obtaining a score corresponding to passing a "city " therealong or the technique required to advance one ball while letting another ball stay in a dead end branch path.

However, in the above-mentioned example, the moving body is an individual piece, and the path along which the piece can be moved is predetermined. Thus, one cannot enjoy unlimited changes, as from the fluidity of the particles of a quantity of sand.

In the case of the decorative object of the inventor's previous utility model application, the decorative object is formed of sand and a container for the sand with only a front glass cover, i.e. only two plates, and even if variously colored sands are flowed in it, therefore, only the change of the wave patterns is noted. Also, when the sand flows repeatedly, fine scratches are caused on the glass surface, and it cannot be avoided that the glass gradually loses its transparency and becomes cloudy therefrom. Also, the specific gravities of its sand and glass are large, and its weight becomes too considerable for portability, therefore, and its handling becomes awkward. Furthermore, although natural sands have colors, generally speaking, they are dull, monotonous colors, and sand of a specific color is hard to obtain.

SUMMARY OF THE INVENTION

Therefore, improvement and development of the above-mentioned decorative object for souvenirs is an object of the present invention, and such a multipurpose board, also suitable for amusement, has been obtained.

In the present invention, the space within a frame of relatively shallow thickness is segregated into multiple layers and covered by spaced transparent plates to form a board-like object. For example, a frame spacedly supports at least three transparent plates by their peripheries in spaced condition defining segregating clearances therebetween while still having the relatively shallow-thickness form of a board. Particles with suitable fluidities, i.e. independence, are in each clearance between the transparent plates in amounts only partially filling the clearance so that both modes of standstill and flow of the particles can be generated by leaving the frame stand still or moving it.

The resulting multipurpose board can be used as an ornament, a wall hanging, or a table-standing item of interior design; or a memento of a trip; a souvenir; a present; a sample; a teaching material; etc. It can also be used for amusement by selecting particles which can be enjoyed by observing incessant changes of the particles in flow. Furthermore, it can be used as a game board by setting forth the rules of such game.

The particles in the respective clearances also have differing physical properties, such as shape, size, material of color.

The elements which constitute this invention can be modified in numerous ways by adopting technologies known in various industrial fields. While glass can be used as the most familiar transparent plate, various plastics of an excellent transparency based on recent synthetic-resin technology can also be utilized. As for the frame material, such familiar materials as wood, metal and plastics can be used. The appearance as an art work becomes complete, however, when a decorative frame material is used.

As for the particles which fill each clearance between the transparent plates partially, natural sand, artificially crushed sand, wood chips or glass or plastic beads can be used alone or in any combination.

The transparent plates can be used in such additional number, over three, as adequately corresponds to the kinds of particles to be used. Their clearance spacing can be even, i.e. the same, or uneven, and the plates can be in parallel or not in parallel, so as to give additional variation to the flow of the particles.

The whole body of the board of this invention is designed according to the purpose of its use. The shape of the front, i.e. an outermost transparent plate, is not limited, and square, rectangular, polygonal, circular, or elliptical peripheral shapes therefore can be selected arbitrarily.

Similiarly, the shape of a container to accommodate the whole board is independent of the shape of the board, and can take a format which suits the purpose of the use. On this outer container box, a use instruction, which describes the methods of use of the board, or an explanation of the content, can be attached. For use as a game board, a manual on game rules may also be attached.

BRIEF DESCRIPTION OF THE DRAWINGS

The board of this invention can be understood better through the following detailed explanation of preferred embodiments, which are shown in the attached drawings, in which.

DETAILED DISCLOSURE

Figure 1:
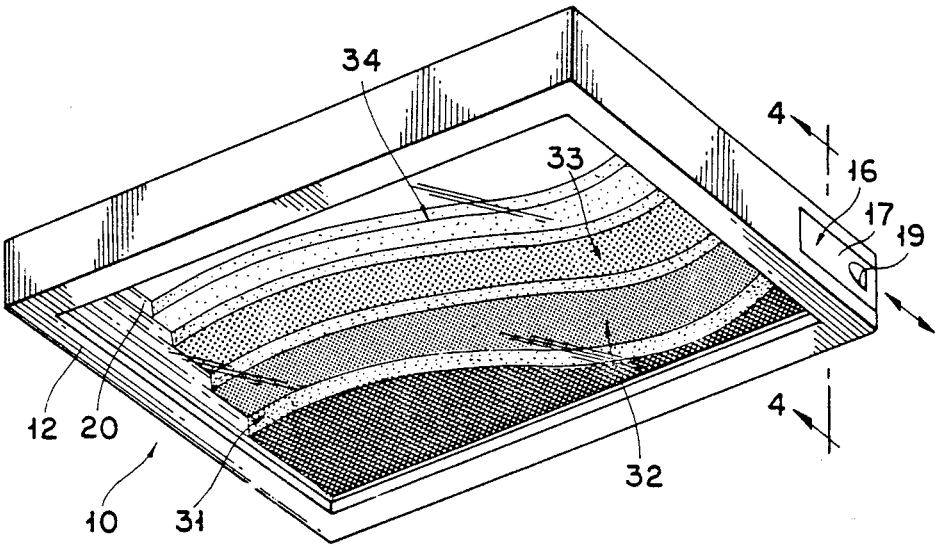
FIG. 1 is a perspective view of one preferred embodiment.
Figure 4:
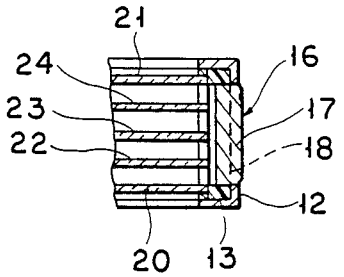
FIG. 4 is a cross sectional elevation of a portion with an opening for charging of the embodiment of FIG. 1 at Line 4—4 of FIG. 1.

FIG. 1 is a perspective view of the whole of a rectangular multipurpose-board embodiment at 10 of this invention. It has a decorative frame 12 peripherally about a front transparent plate 20 and, as shown in FIG. 4, corresponding shaped transparent plates 21, 22, 23 and 24. Transparent plate 21 is the rear plate. The front and rear plates are the outermost plates with the others therebetween. For this, the frame 12 holds the transparent plates 20, 21, 22, 23, 24 peripherally, in spaced condition defining respective segregating clearances, i.e. space, the spaces being of from 0.5 to 15 mm between each two successive plates. Particles at 31, 32, 33, 34 (not shown in FIG. 4) of respectively different physical properties, as shown in FIG. 1, respectively fill the segregating clearances only partially, their partial filling of the segregating clearances progressively increasing from front plate 20 to rear plate 21, so that some of the particles at each of 31, 32, 33, 34 can be seen through the front transparent plate 20.

Figure 2:
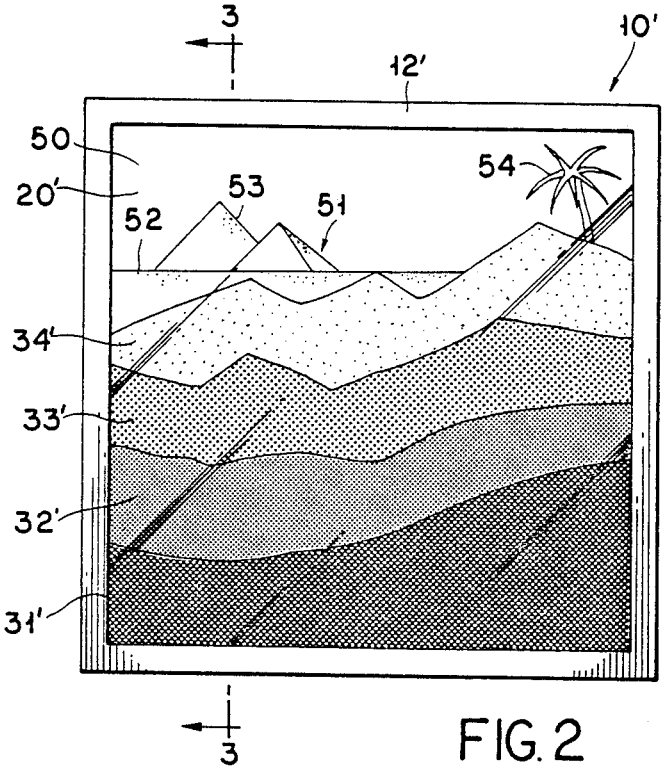
FIG. 2 is another preferred embodiment.
Figure 3:
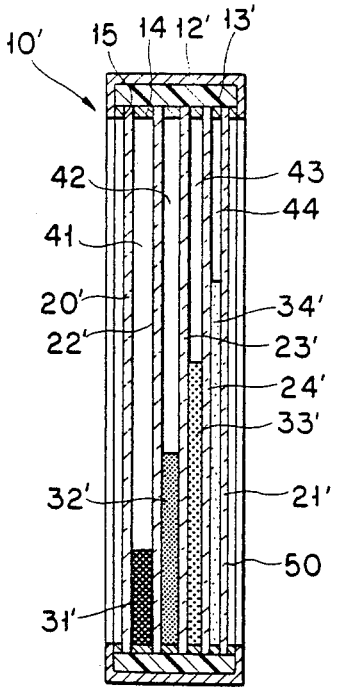
FIG. 3 is a cross sectional elevation of a portion of the embodiment of FIG. 2 at Line 3—3 of FIG. 2.

The embodiment shown in FIGS. 2 and 3 is the same as that of FIGS. 1 and 4, except as later described.

FIG. 3 shows construction detail of the frame 12'. Each side of the frame 12' (only two shown) is inwardly U-shaped with a four-sided frame member 13' therein. Spacers 14 are fixed to the insides of the inner frame members 13' to define grooves 15 between the spacers for receiving the rims of the front and back transparent plates 20' and 21', and the intermediate transparent plates 22', 23' and 24'. These five plates thus define segregating clearance 41, 42, 43, 44 between the plates. The frame members 13' support the five plates in the above-mentioned manner, so the frame 12' fixed outside it can be merely decorative. Thus, the supporting frame 13', the front transparent plate 20' and the back plate 21' constitute a flat shallow container segregated by the interim plates 22', 23' and 24'.

The particles 31, 32, 33, 34 of FIG. 1, which are accommodated in the respective segregating clearances of FIGS. 1 and 4, can be charged through an entrance at 16, which is provided at a corner of the supporting frame 12, as shown in FIGS. 1 and 4. Alternatively, specific amounts of the various particles 31', 32', 33' and 34' of FIGS. 2 and 3 can be charged into the spaces 41, 42, 43 and 44 as the frames and plates are assembled.

As shown in FIGS. 1 and 4, the entrance 16 is located near a corner of the rectangular decorative frame 12, and has a lid 17 extending to the corner. As known, the lid 17 has stepped grooves 18 along its sides which engage the frame 12 so it can be freely slid open or closed in the arrowed directions (FIG. 1). It is opened via a pawl groove 19 in its outside face and closed by pushing from its end. Keeping it closed is accomplished by friction holding.

The amount of particles partially filling the segregating clearances is smallest at the front plate and increase in the spaces in the direction of the back side therefrom. The amounts are determined in such a way the some of the particles in each segregating clearance can be seen from the front side, even if the clearance get progressively narrower, as shown in FIG. 3. Alternatively, the volumes of the particles could gradually decrease toward the back side, however.

The materials which constitute various parts of the board at 10 are described below. The material used for the four-sided, inner frame 13 is ordinarily wood, or plastic as shown in FIGS. 3 and 4. The material for the transparent plates 20, 21, 22, 23 and 24 is normally glass. It is desirable to choose a metal plate for the decorative frame 12 for reinforcing.

There is no constraint on the way of assembling these components in other embodiments (not shown). The inner frame may be integrated with the spacers, and the grooves than may be cut into the inside thereof. The glass plates 20, 22, 23, 24 and 21, may be placed within the frame 13 alternately with the spacers 14 from one side of the frame or the other. Three sides of the frame 13, on which the spacers 14 or the grooves 15 are installed, may also be assembled, and the glass plates installed therein, and then the remaining, fourth side of the frame may be fixed thereto.

It is desirable that the particles be natural, particularly specific sand from such countries as are perceived to be exotic. A number of sands of different colors from different places may also be selected. The above-mentioned entrance 16 may be used for charging them, or they can be charged at the time of assembling the frame and plate container therefor. Natural sand is to be screened to an effective particle-size range, and those particles charged into each space. For a relatively larger scale board, it is preferable to use sand of a larger particle size.

The construction of the back plate 21 is described below. In the embodiment of FIGS. 1 and 4, the back plate 21 is essentially the same type of glass plate as that of the front transparent plate 20. In the embodiment of FIG. 2 and 3, however, a layer 50 is applied to the back, outermost side of the back plate 21. In this embodiment, it is a sheet coated on the plate 21 with scenery at 51 drawn on it. An horizon 42, pyramids 53, palm trees 54, etc., are drawn on it in association with the amounts of sand particles in the segregating clearances. The scenery may be on a paper layer 51 attached to the plate. The layer may also be another kind of thin film or sheet. Similarly, the same or other scenery could be drawn on a surface of the back plate 21, which surface also could be that seen from the front side, i.e. the inside of the back plate. The layer 50 may make the back plate substantially nontransparent, in which case the front plate and the back plate of the board at 10 are clearly defined. In such a case, the decorative frame 12 can be constituted with a main emphasis on the front.

FUNCTION

The above-mentioned board 10 accommodates particles such as sand in the container 11. It is an exhibition case, because it is covered by the front glass plate 20, and can be used as a decorative ornament, whether it is placed upright or horizontally, to enjoy the modelings formed in the segregating clearances by the sand. If the board 10 is on a small scale, it can be stood on a table. On dining tables, it can be used as a coaster. In the case of large- and medium-scale boards, it can be used as a wall hanging. For the scenery 51, an artistic painting or photograph can be used. Also, if the board 10 is made in a special form, instead of the quadrilateral, it can create an accent on a decorative shelf in conjunction with a separate stand (not shown).

If the board 10 is held in hands and swung back and forth, left to right, and up and down, movement of the particles is generated, causing flows of the sands in the individual segregating clearance spaces. These can be seen from the front side, and the differences in the physical properties of the sands contained create complex patterns in the multiple, clearance layers throughout the time of movement. To the extent that such changes are enjoyed, the board can be regarded as an amusement. If sands of darker color for the front side ad lighter color for the back side are selected, a scenographic view is created in combination with differences in the volumes of the sands. The wave form at the upper level of each layer reminds one of a sandhill, and it depicts, in combination with the scenery 51 on the back plate 21, a desert in an exotic country. One can also enjoy the horizon 52 together with unlimited changes through appearance and disappearance of some of the scenery, as at 53 and 54, for example.

Various other designs are possible for the above-mentioned board, in accordance with various purposes. First of all, the clearances of the transparent plates can be changed to control the degrees of freedom of the particles in the clearances. Namely, when the particles are the same, the wider the clearance between the plates, the freer the movement of the particles becomes. Owing to the angle of repose inherent in sand, the wave length also become larger. Oppositely, when the clearance becomes narrower, the slope becomes sharper, and small waves appear and, thus, a more scenographic view can be obtained. Making the plates not parallel also changes the movement of the sands. It then requires a skill to control the resulting different movements of the sands, and the enjoyment and control get elevated to a higher order.

The particle sizes of the sands are in a range of from 0.05 mm to 5 mm. Sand with a particle size of 0.1 mm–1 mm is preferable. Well dried sand is to be used.

The next variable item is the material of the container. Despite the above description, plastic materials can be used for the frame and transparent plates. This substitution reduces the total weight of the board and increases the possibilities of its configuration. Since this material is artificial, the color can be chosen, and the contrast of the colors of each material used can also be freely designed.

Furthermore, a combination of a glass plates and glass beads is possible, and these match each other well.

Figures and designs which are drawn on the inner side of the applied layer 50 which is installed at the outer surface of the back plate 21 are entirely free, and all sorts of backgrounds may be adopted. For an amusement board, a target shape which is set forth according to a rule may be drawn on the applied layer 50, and one can try to adjust the flow of the particles toward achieving such a target.

The board of the invention is not limited by this description, but may be modified.

I claim:

1. A multipurpose board for a variable, layered pattern, comprising:

a least three transparent plates;

a supporting frame having support means for supporting the plates by their peripheries in a spaced condition forming respective segregating clearances therebetween;

particles in each segregating clearance between the plates, the particles in each segregating clearance having a physical property which differs from that of the particles in the next adjacent segregating clearance, and the particles in each segregating clearance only partially filling the segregating clearance, whereby to be movable in the segregating clearance upon appropriate movement of the supporting frame.

2. A multipurpose board as described in claim 1, in which the particles are selected from the group consisting of natural sand, artificially crushed sand, glass beads, plastic beads, wood chips and any combination thereof.

3. A multipurpose board as described in claim 1, in which the physical property of the particles is selected from the group consisiting of shape, size, material and color.

4. A multipurpose board as described in claim 1, in which each plate is one of a glass plate or a plastic plate.

5. A multipurpose board as described in claim 1, in which all the plates are parallel.

6. A multipurpose board as described in claim 1, in which the plate spacings forming the clearance between all the plates are substantially the same.

7. A multipurpose board as described in claim 1, in which two of the plates are outermost, one of the two plates defining a front side and the other defining a back side, the clearances between the plates being progressively narrower or wider from the front side to the back side.

8. A multipurpose board as described in claim 1, in which two of the plates are outermost, one of the two defining a front side and the other defining a back side, the two plate being in parallel, but the third plate not being in parallel therewith.

9. A multipurpose board as described in claim 1, in which the circumference of each plate is square, polygonal, or circular in shape.

10. A multipurpose board as described in claim 1, in which each plate is mutually equal in size.

11. A multipurpose board as described in claim 1, in which the particles are in a size range from 0.05 mm to 5 mm, and the physical property is the size of the particles.

12. A multipurpose board as described in claim 1, in which the plate spacings forming the clearances between the plates are from 0.5 mm to 15 mm.

13. A multipurpose board as described in claim 1, in which two of the plates are outermost, one of the two defining a front side and the other defining a back side, the partial filling of the segregating clearances with the particles progressively increasing from the front side toward the back side.

14. A multipurpose board as described in claim 1, one of the plates having an outer side, whereby to define a back side, and further comprising a non-transparent material applied to the outer side.

15. A multipurpose board as described in claim, 14 and further comprising figures or designs drawn on the outer side of the one plate, whereby to be between the one plate and the non-transparent material applied thereo.

16. In a multipurpose board for a variable, layered pattern, the board having at least a transparent plate and another plate, a frame having support means for peripherally supporting the plates laterally in the frame in a spaced condition forming a segregating clearance, and first particles in the segregating clearance, the improvement comprising:

at least a third plate so supported by the support means of the frame in a spaced condition with respect to the other plates for forming another segregating clearance, the third and other plate also being transparent; and second particles in the other segregating clearance, the second particles having a physical property which differs from the first particles, whereby to be distinguishable therefrom, the first and second particles only partially filling the respective segregating clearances they are in, whereby the first and second particles are movable in the respective segregating clearances upon movement of the frame and, at least upon appropriate movement of the frame, both visible simultaneously transversely through the plates successively for an actual appearance of depth of the particles in the segregating clearances.

* * * * *